US008504192B2

(12) United States Patent
Faivre et al.

(10) Patent No.: US 8,504,192 B2
(45) Date of Patent: Aug. 6, 2013

(54) METHOD OF SORTING MAILPIECES BY USING A PROCESS FOR DYNAMICALLY ALLOCATING SORTING OUTLETS

(75) Inventors: Lionel Faivre, Valence (FR); Bruno Cartal, Montelier (FR); Frederic Badier, Saint Peray (FR)

(73) Assignee: Solystic, Gentilly Cedex (FR)

( * ) Notice: Subject to any disclaimer, the term of this patent is extended or adjusted under 35 U.S.C. 154(b) by 326 days.

(21) Appl. No.: 12/514,827

(22) PCT Filed: Dec. 12, 2008

(86) PCT No.: PCT/FR2008/052292
§ 371 (c)(1),
(2), (4) Date: May 14, 2009

(87) PCT Pub. No.: WO2009/081008
PCT Pub. Date: Jul. 2, 2009

(65) Prior Publication Data

US 2010/0318216 A1 Dec. 16, 2010

Related U.S. Application Data

(60) Provisional application No. 60/996,972, filed on Dec. 13, 2007.

(51) Int. Cl.
*B07C 5/00* (2006.01)

(52) U.S. Cl.
USPC ..... 700/223; 209/583; 209/584; 700/215

(58) Field of Classification Search
USPC ..... 700/223–224, 228–230; 209/583–584
See application file for complete search history.

(56) References Cited

U.S. PATENT DOCUMENTS

| | | | |
|---|---|---|---|
| 5,901,855 | A | 5/1999 | Uno et al. |
| 6,079,570 | A | 6/2000 | Oppliger et al. |
| 6,107,587 | A | 8/2000 | Itoh et al. |

(Continued)

FOREIGN PATENT DOCUMENTS

| | | |
|---|---|---|
| CA | 2547271 | 11/2007 |
| DE | 60001405 | 11/2003 |

(Continued)

OTHER PUBLICATIONS

Notice of Opposition for European Patent No. 2225049, dated Jun. 14, 2012, 50 pages.

*Primary Examiner* — Gene Crawford
*Assistant Examiner* — Kyle Logan
(74) *Attorney, Agent, or Firm* — Rothwell, Figg, Ernst & Manbeck, P.C.

(57) ABSTRACT

A method of sorting mailpieces amongst N logical sorting destinations with a sorting machine including a mailpiece conveyor that serves M sorting outlets, each of which is provided with a removable mailpiece storage tray that is handled by a tray conveyor, where M is less than N, consists in detecting that a current mailpiece to be sorted has a certain logical destination that is said to be "overbooked" and that is not associated with a sorting outlet, and in dynamically allocating to said overbooked logical destination a certain sorting outlet of the machine that is occupied by another logical destination. In said certain sorting outlet, a tray change is made and the tray extracted from said certain sorting outlet is put on standby on a loop of the tray conveyor.

7 Claims, 4 Drawing Sheets

U.S. PATENT DOCUMENTS

| | | | | |
|---|---|---|---|---|
| 6,107,589 | A | 8/2000 | Yamashita et al. | |
| 6,227,378 | B1 | 5/2001 | Jones et al. | |
| 6,283,304 | B1 * | 9/2001 | Gottlieb et al. | 209/603 |
| 6,573,748 | B1 | 6/2003 | Trimberger | |
| 6,907,982 | B2 * | 6/2005 | Olson et al. | 198/465.1 |
| 7,923,655 | B2 * | 4/2011 | Quine et al. | 209/584 |
| 2005/0056573 | A1 * | 3/2005 | Berdelle-Hilge | 209/584 |
| 2006/0070929 | A1 * | 4/2006 | Fry et al. | 209/583 |
| 2006/0113223 | A1 * | 6/2006 | Quine et al. | 209/584 |
| 2006/0124513 | A1 * | 6/2006 | McLaughlin et al. | 209/584 |
| 2006/0219611 | A1 * | 10/2006 | Madar et al. | 209/584 |
| 2006/0259186 | A1 * | 11/2006 | Cartal et al. | 700/226 |
| 2007/0007946 | A1 | 1/2007 | Uekert et al. | |
| 2007/0090027 | A1 | 4/2007 | Haselberger et al. | |
| 2007/0272601 | A1 * | 11/2007 | Cormack | 209/584 |
| 2009/0216366 | A1 * | 8/2009 | Zuber et al. | 700/215 |

FOREIGN PATENT DOCUMENTS

| | | | |
|---|---|---|---|
| DE | 10305847 | B3 | 8/2004 |
| DE | 102005055763 | B3 | 4/2007 |
| EP | 1726371 | A1 | 11/2006 |
| EP | 1820575 | A1 | 8/2007 |
| EP | 1655080 | B1 | 8/2012 |
| WO | 2006100601 | A1 | 9/2006 |

* cited by examiner

METHOD OF SORTING MAILPIECES BY USING A PROCESS FOR DYNAMICALLY ALLOCATING SORTING OUTLETS

CROSS-REFERENCE TO RELATED APPLICATIONS

This application is a 35 U.S.C. 371 National Phase Application from PCT/FR2008/052292, filed Dec. 12, 2008, and designating the United States, which claims the benefit of U.S. Provisional Application No. 60/996,972, filed Dec. 13, 2007.

BACKGROUND OF THE INVENTION

Field of the Invention

The invention relates to a method of sorting mailpieces amongst N sorting destinations of a sort plan with a sorting machine including a mailpiece conveyor that serves M sorting outlets, each of which is provided with a removable mailpiece storage tray that is handled by a tray conveyor.

The invention is more particularly applicable to sorting mailpieces of the "large-format" type, also known as "flats", on sorting machines having bin carrousels, but the invention can be applied to sorting other mailpieces. Such machines are relatively voluminous.

SUMMARY OF THE INVENTION

An object of the invention is to enable sorting machines to be more compact by proposing a sorting method in which, in the sort plan, the M sorting outlets are associated with only a subset of the N logical destinations.

An object of the invention is thus to propose a method of sorting mailpieces that is simple and that preserves the operating rate of a bin carrousel of a sorting machine, and that uses an under-dimensioned sorting machine that is very compact, i.e. that has a number of sorting outlets that is less than the number of destinations for the mailpieces.

To these ends, the invention therefore provides a method of sorting mailpieces amongst N sorting destinations with a sorting machine including a mailpiece conveyor that serves M sorting outlets, each of which is provided with a removable mailpiece storage tray that is handled by a tray conveyor, said method being characterized in that it comprises the following steps:

- detecting that a current mailpiece to be sorted has a certain logical destination that is said to be "overbooked" and that is not associated with a sorting outlet; and
- in response to such detection, dynamically allocating to said overbooked logical destination a certain sorting outlet of the machine that is already occupied by another logical destination, making a storage tray change in said certain sorting outlet, and putting the tray extracted from said certain sorting outlet on standby on a loop of the tray conveyor.

The method of the invention can present the following features:

- the storage tray extracted from said certain sorting outlet is put into re-circulation on a closed-loop path of the tray conveyor, and the mailpieces corresponding to said other logical destination are put into re-circulation on a closed-loop path of the mailpiece conveyor;
- a first subset of the sorting outlets are associated with a first subset of the N logical destinations, and a second subset of the sorting outlets are associated with a second subset of the N logical destinations, and, if it is detected that a logical destination of the second subset of logical destinations is in an overbooked state, a certain sorting outlet that belongs to the first subset of sorting outlets is dynamically allocated to said overbooked logical destination;
- said certain sorting outlet is chosen by considering the instantaneous or forecast occupancy of the sorting outlets; and
- the method is a method for sorting mailpieces of the "large-format" or "flats" type, wherein a bin carrousel is used for moving the mailpieces along the sorting outlets.

The basic idea of the invention is thus to allocate the sorting outlets dynamically to the logical destinations, and to change trays on a sorting outlet that is dynamically allocated to a logical destination, the tray extracted from said sorting outlet being put on a standby loop of the tray conveyor. The dynamic allocation and the tray change can be performed sufficiently quickly to avoid mailpieces destined for a logical destination that is put dynamically into the overbooked state needing to travel the entire length of the standby loop of the mailpiece conveyor. The trays extracted from the dynamically allocated sorting outlets can be partially full trays that, during the sorting process, can be brought back to a dynamically allocated sorting outlet for the purpose of storing more mailpieces. The partially full trays are thus re-circulated to the sorting outlets of the machine. The method of the invention is more particularly applicable to sorting "large-format" mailpieces or "flats" on a mailpiece conveyor of the bin carrousel type.

The advantage of the method of the invention is that it makes it possible to use a sorting machine whose dimensioning is optimized relative to the number of destinations of the mailpieces to be sorted. In addition, this method makes it possible to optimize filling of the trays, i.e. to remove the trays from the machine only once they are full.

BRIEF DESCRIPTION OF THE DRAWINGS

The present invention can be better understood and other advantages appear on reading the following detailed description of an implementation given by way of non-limiting example and shown by the accompanying drawings, in which.

DETAILED DESCRIPTION OF THE PREFERRED EMBODIMENTS

Figure 1:
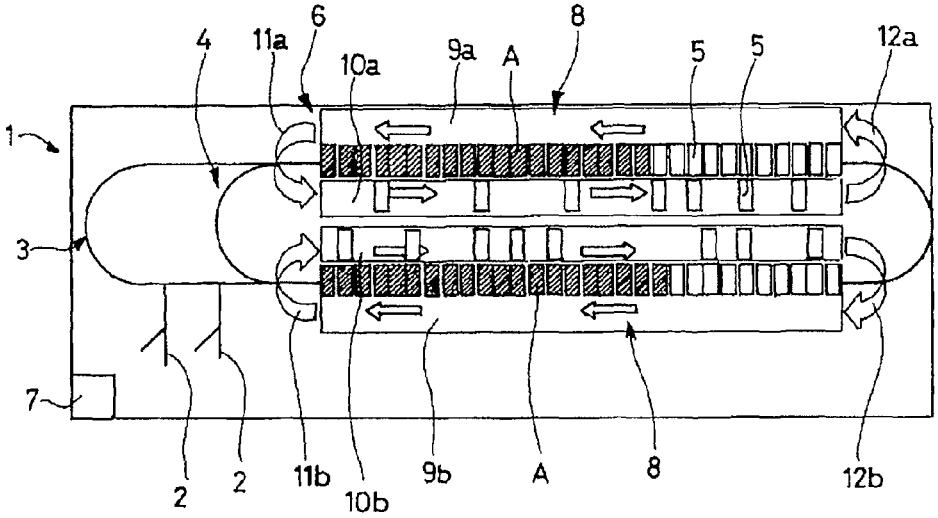
FIG. 1 is a highly diagrammatic view of a bin-carrousel postal sorting machine of the invention in a first operating state.

In the following description of the sorting process of the invention, it is considered that a sorting machine 1 is used that has two feed inlets with 480 physical sorting outlets for sorting 600 logical destinations of a sort plan. Each logical destination can correspond to a plurality of delivery points of a delivery round or "postman's walk".

It is considered that 300 physical outlets of the machine are associated in the sort plan with a first group of 300 logical destinations while the 180 other sorting outlets of the machine are associated with only a fraction (180 logical destinations) of the logical destinations of a second group of 300 logical destinations, which group constitutes another virtual sorting machine.

Thus, in this example, with the two disjoint groups of logical destinations, it can be said that two virtual sorting machines are formed that make use of respective ones of two disjoint subsets of sorting outlets of the sorting machine 1 that are designated by A and B in FIGS. 1 to 6.

The sorting process of the invention is particularly effective in the situation described below, but can also operate with a single group of 600 logical destinations assigned to the 480 physical sorting outlets of the sorting machine 1. In which case, the number of sorting outlets is also less than the number of logical destinations to be processed on the machine.

In FIG. 1, the sorting machine 1 for sorting mailpieces, and more particularly large-format mailpieces or "flats", thus has two feed inlet lines 2 with automatic unstacker devices feeding a mailpiece conveyor 3 of the bin carrousel type. In this example, each bin is arranged to move one mailpiece at a time. On exiting from the unstacker devices 2, each mailpiece goes through an address reader device (not shown) for reading and automatically recognizing its address, e.g. by Optical Character Recognition (OCR). On exiting from the address reader devices, each mailpiece is injected into a bin of the carrousel 3, the bins of the carrousel circulating around a closed-loop path above the physical sorting outlets (not referenced) of the machine 1 that are, in this example, distributed over two opposite sides of the machine 1. The carrousel 3 is therefore designed to enable mailpieces to be put into re-circulation on a standby loop 4 in temporary manner. The mailpiece conveyor 3 is operated by a monitoring and control unit 7.

Each sorting outlet is provided with a mailpiece storage tray 5. The storage capacity of each tray is about fifty mailpieces. The trays 5 of the sorting outlets are removable and interchangeable.

As shown in FIG. 1, the sorting machine 1 also includes a tray conveyor 6 designed to transport the trays along the sorting outlets. Said tray conveyor 6 is suitable for loading and unloading a tray 5 at each sorting outlet. The tray conveyor 6 is also arranged to go along the sorting outlets by following a closed-loop path 8, thereby enabling partially filled trays to be temporarily put into re-circulation (put on standby) on a standby loop as described below.

In FIG. 1, it can be seen that the closed-loop path 8 of the tray conveyor 6 passes in front of and behind the sorting outlets of the machine so that the trays enter and exit from each sorting outlet on a first in, first out (FIFO) basis. More particularly, in this example, the tray conveyor 6 has two "outside" conveyor segments 9*a*, 9*b* (also called "Outside Tray Accumulation Conveyors" or "OTACs") connected to respective ones of two "inside" conveyor segments 10*a*, 10*b* (also called "Inside Tray Accumulation Conveyors" or "ITACs") via input and output tray transfer devices 11*a*, 11*b*, 12*a*, 12*b* (also called "Input Transfer Devices" or "ITDs" and "Output Transfer Devices" or "OTDs").

The conveyor segments 9*a*, 9*b* thus extend along the fronts of the sorting outlets for unloading trays from them, while the conveyor segments 10*a*, 10*b* extend along the backs of the sorting outlets for loading them with trays. The tray conveyor 6 is also operated by the unit 7.

Sorting each mailpiece, i.e. transporting the mailpiece from the feed inlet 2 to a sorting outlet tray 5 is performed on the basis of the sort plan in which each sorting outlet of the machine is associated with a logical destination derived from the postal address that is read automatically from the surface of the mailpiece. The sort plan can be thought of as a table of association that is put in a memory in the unit 7 and that associates a logical destination with a delivery point (e.g. a postal address), the logical destination also being associated in a machine memory with a sorting outlet, thereby enabling the unit 7 to control the mailpiece conveyor 3 and the tray conveyor 6. In accordance with the invention, allocating (or assigning) a sorting outlet to a logical destination for a mailpiece takes place dynamically, i.e. while the mailpiece is traveling in the mailpiece conveyor 3. In addition to this dynamic allocation, mailpiece thickness can be measured in the sorting machine so as to anticipate the filling levels of the sorting outlet trays and so as to compute tray replacement requests based on a filling level limit.

When the postal address of a mailpiece has been recognized automatically, the unit 7 can thus associate the mailpiece with a logical destination and normally with a sorting outlet. Since the sort plan requires 600 logical destinations whereas the sorting units have only 480 physical outlets, the association of a logical destination with a physical sorting outlet is not a one-to-one association but rather it is a dynamic association that does not exist throughout the whole of a sorting pass and that can thus move from one physical sorting outlet to another during said pass.

At the beginning of a sorting pass, it is considered that a first inlet 2 of the machine is used with mailpieces destined for the group A of logical destinations indicated in FIG. 1. 300 physical sorting outlets are thus used for starting a sorting pass with the group A. These sorting outlets are initially provided with empty trays. At this stage, the other feed inlet of the machine is not used with mailpieces destined for the group B of logical destinations.

The trays of the outlets of the group A are thus filled as the mailpieces of the group A pass through the conveyor 6.

FIG. 1 shows the operating state of the sorting machine at this stage of the sorting process by using rectangles with right hatching to show the partially filled sorting outlet trays 5 that are associated with the group A and by using blank rectangles to show sorting outlet trays 5 that are not associated with any logical destination. On the inside conveyor segments 10*a*, 10*b*, empty trays 5 are also shown (using blank rectangles) that are traveling along the backs of the sorting outlets in the direction indicated by the arrows.

The trays 5 in the conveyor 6 can be identified and tracked by the unit 7 by means of machine-readable codes, such as bar codes.

Figure 2:
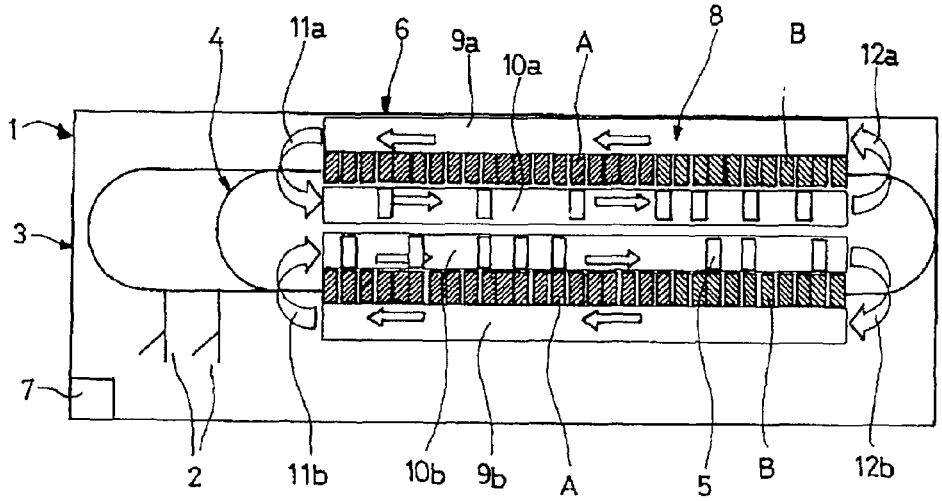
FIG. 2 is a highly diagrammatic view of the postal sorting machine in a second operating state.

When a first tray containing mailpieces that are to be sorted amongst the group B of logical destinations enters the machine 1, e.g. at an address reader device, mailpieces to be sorted amongst the group A of logical destinations are still being directed towards the partially filled trays corresponding to the group A. For the mailpieces destined for the group B, only 180 logical destinations are associated in the sort plan with 180 remaining physical outlets of the machine 1, which outlets are not used for sorting the mailpieces of the group A. FIG. 2 shows an operating state of the sorting machine 1 during a first sorting stage during which the mailpieces destined for the groups A and B of logical destinations are sorted simultaneously, the mailpiece conveyor 3 being fed at the same time from both of the inlets 2 of the machine. During this stage, mailpieces also come to fill the sorting outlets associated with the logical destinations of the group B. In FIG. 2, a set of trays 5 partially filled with mailpieces associated with the group B of logical destinations are shown using rectangles with left hatching.

There comes a time when a first mailpiece and then each of other mailpieces to be sorted amongst the group B of logical destinations is present in the conveyor 3 and cannot be sorted because its sorting logical destination is not associated with an actual sorting outlet in the sort plan, since the number of sorting outlets is insufficient for the 600 logical destinations. Such a logical destination is then said to be in an "overbooked" state, and this state is detected by the unit 7. In response to a logical destination being detected as being in an overbooked state (one or more mailpieces are present in the conveyor 3 and each of them has a logical destination that is not currently associated with a sorting outlet of the machine), the unit 7 launches a process of dynamically allocating physical sorting outlets.

In this dynamic allocation process, the unit 7 can monitor the instantaneous occupancy or activity of the physical sorting outlets. When a mailpiece to be sorted amongst the group B of logical destinations has a logical destination that is overbooked, the unit 7 can, for example, choose a physical outlet that is associated with the group A of logical destinations and that presents the lowest occupancy, and thus control the tray conveyor 6 to replace the partially full tray of that sorting outlet with an empty tray that is suitable for receiving the mailpieces to be sorted for said overbooked destination. The partially full tray of said sorting outlet is thus removed on the outside conveyor segment 9*a*, 9*b* and the empty tray is brought in by the inside conveyor segment 10*a*, 10*b*.

Said sorting outlet can, for example, be selected as a function of the forecast number of mailpieces that it is to receive, e.g. the number of mailpieces present in the conveyor 3 and that are destined for it in the sorting plan. The selection criterion is that of the outlet having the lowest occupancy.

Figure 3:
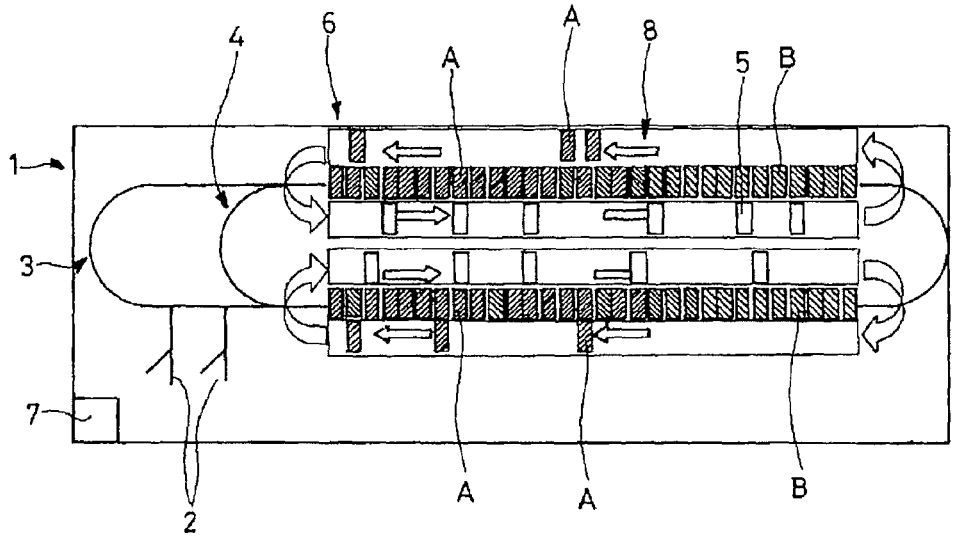
FIG. 3 is a highly diagrammatic view of the postal sorting machine in a third operating state.
Figure 4:
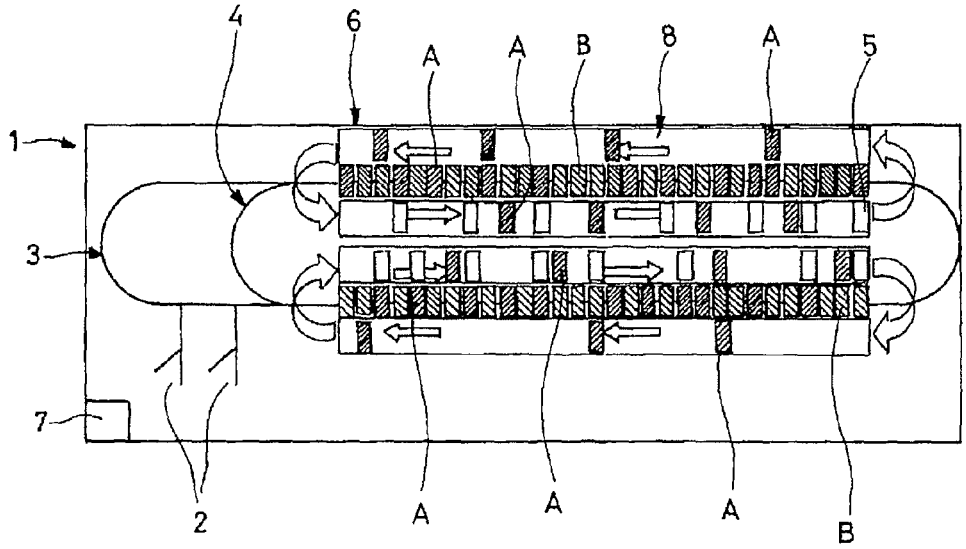
FIG. 4 is a highly diagrammatic view of the postal sorting machine in a fourth operating state.

It is thus possible to have to change a plurality of partially full trays with a plurality of empty trays in the sorting outlets. FIGS. 3 and 4 show the machine 1 in operating states in which partially full trays associated with the group A are traveling in the conveyor 6 together with empty trays. In order to avoid causing congestion on the inside conveyor segment 10*a*, 10*b*, the trays reaching the downstream end of the inside conveyor segment 10*a*, 10*b* are transferred to the outside conveyor segment 9*a*, 9*b* by the tray transfer device 12*a*, 12*b*. Thus, empty trays can be transferred to the conveyor segment 9*a*, 9*b* when they reach the downstream end of the conveyor segment 10*a*, 10*b*, and partially full trays can transferred to the conveyor segment 9*a*, 9*b* either after being unloaded from sorting outlets when they are replaced with other trays, or else when they reach the downstream end of the inside conveyor 10*a*, 10*b*.

Figure 5:
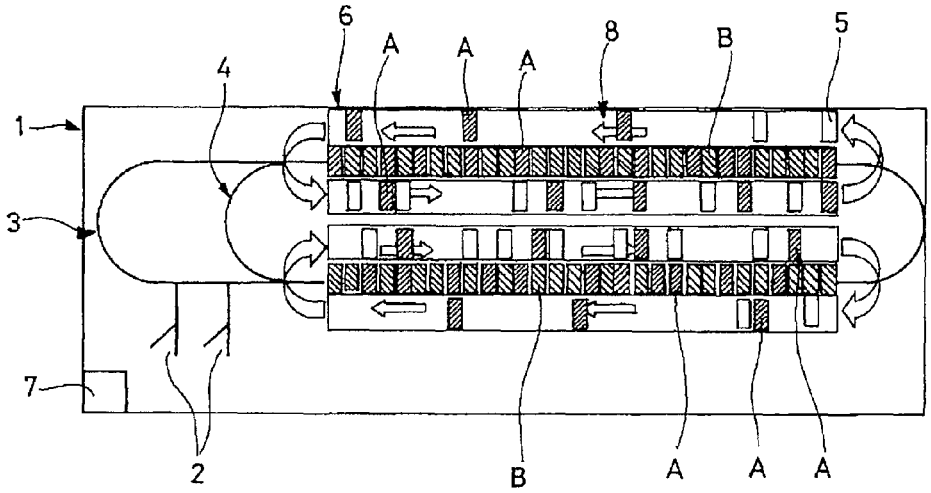
FIG. 5 is a highly diagrammatic view of the postal sorting machine in a fifth operating state.
Figure 6:
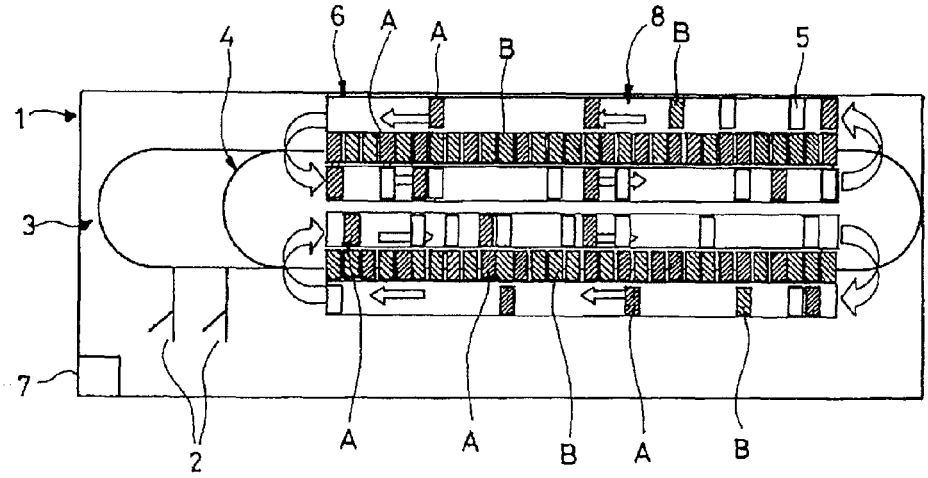
FIG. 6 is a highly diagrammatic view of a postal sorting machine in a sixth operating state.

FIG. 5 shows the state of the machine while empty trays and partially full trays are being re-circulated on the outside conveyor segment 9*a*, 9*b* during the sorting process. Finally, it happens that, in the mailpiece conveyor 3, mailpieces need to be sorted into a logical destination of the group A that has become overbooked. The dynamic allocation process that is performed then requires the partially full tray that has already been used for receiving the mailpieces associated with the overbooked logical destination to be brought back to a sorting outlet, namely the sorting outlet that, at a given time presents the lowest occupancy. Said partially full tray can thus be loaded into one of the sorting outlets that is associated with the group B. From that time on, partially full trays associated with the group A, partially full trays associated with the group B, and empty trays are in circulation around the closed-loop path 8, and the partially full trays are re-circulated to the sorting outlets by the unit 7, as shown in FIG. 6.

In order not overload the tray conveyor 6, which could slow down the process of re-circulating the trays, a limited quantity of empty trays are accepted on the inside conveyor segment 10*a*, 10*b*. Once that limit is reached, additional empty trays, e.g. coming from an Infeed Conveyor System (ICS), are put on standby in an empty tray reserve. This makes it possible to keep the trays flowing smoothly inside the conveyor 6 and to prepare quick tray changes in the sorting outlets by keeping a local stock of empty trays on the tray storage conveyor.

Re-circulating the trays associated with the group A and with the group B continues until the end of the sorting pass.

Figure 7:
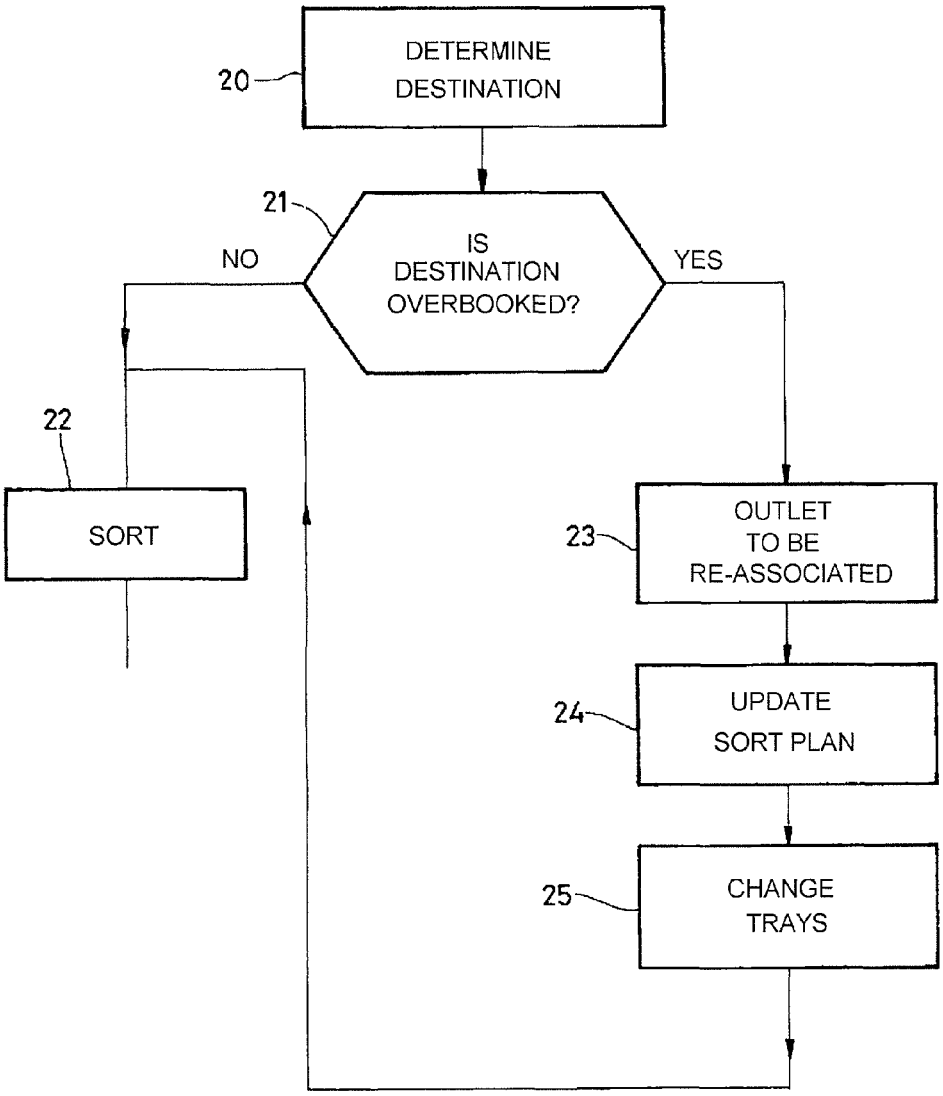
FIG. 7 is a flow chart that shows the main steps of the mailpiece sorting method of the invention with a sorting machine as shown in FIGS. 1 to 6.

FIG. 7 shows the main steps of the dynamic allocation process of the invention.

In step 20, the unit 7 automatically determines the postal address for a current mailpiece entering the sorting machine and thus a logical destination that corresponds to said postal address in the sort plan.

In step 21, the unit 7 checks whether the logical destination is an overbooked logical destination.

If the logical destination is not overbooked, the unit 7 controls the conveyor 6 in the step 22 to direct the mailpiece towards a sorting outlet of the machine 1 that is identified in the sort plan for storage in a tray 5.

If the logical destination of the current mailpiece is overbooked in step 21, then, in step 23, the unit 7 acts on the basis of the instantaneous or forecast occupancy levels of the sorting outlets of the machine to determine an outlet to be reassociated, e.g. the sorting outlet having the lowest occupancy (this level of occupancy can correspond to a rate of filling of the tray). The sort plan in the memory of the sorting machine is then updated dynamically in step 24, so as to associate the logical destination that is overbooked with the sorting outlet having the lowest occupancy that has been determined in step 23.

At the same time, in step 24, the logical destination that was previously associated with that sorting outlet has gone to an overbooked state in the sort plan so that any mailpieces present in the conveyor 3 that have that logical destination are then put into re-circulation by the unit 7 in the standby loop of the conveyor 3 (the unit 7 thus suspends unloading of those mailpieces into a storage tray).

In step 25, the unit 7 also controls the tray conveyor 6 to unload the tray from the sorting outlet, which tray can be partially full, and so as to replace it with a replacement tray, which can be an empty tray, into which the current mailpiece can be unloaded in step 22. The replacement tray can also be a tray that is already partially full if that tray has already been re-circulated during the sorting process.

Naturally, the unit 7 should make this tray change in a sorting outlet in advance of the arrival of the mailpieces in the sorting outlet, and the mailpieces to be directed to said sorting outlet can be put into re-circulation on the standby loop 4 before being unloaded into the sorting outlet. In addition, management of the trays on the conveyor 6 can require the trays to be identified and to be tracked along the conveyor 8 in a manner known per se.

The invention claimed is:

1. A method of sorting mailpieces amongst N logical sorting destinations with a sorting machine including a mailpiece conveyor that serves M sorting outlets, each of which is provided with a removable mailpiece storage tray that is handled by a tray conveyor, said method comprising the following steps:

detecting that a current mailpiece to be sorted has a certain logical destination that is said to be "overbooked" and that is not associated with a sorting outlet; and in response to such detection:

dynamically allocating to said overbooked logical destination a certain sorting outlet of the machine that is occupied by another logical destination, making a storage tray change in said certain sorting outlet by extracting a first partially filled storage tray from said certain sorting outlet and replacing the first storage tray with a second storage tray, and putting the first partially filled storage tray extracted from said certain sorting outlet on standby on a closed-loop of the tray conveyor, and re-circulating the first partially filled storage tray with empty trays on the closed-loop and bringing back said first partially filled storage tray as a replacement for a storage tray in a sorting outlet when a subsequent mailpiece to be sorted has a logical destination that is overbooked and not associated with a sorting outlet, wherein a limited quantity of empty trays is accepted on inner conveyor segments and, once a limit is reached, further comprising a step of placing additional storage trays on standby in an empty tray reserve.

2. A method according to claim 1, wherein the storage trays enter and exit each sorting outlet on a first in, first out (FIFO) basis.

3. A method according to claim 1, wherein the standby loop of the tray conveyor includes two outer segments extending along respective front sides of the sorting outlets and connected with one of two inner segments extending along respective back sides of the sorting outlets to form closed-loops, further comprising the steps of re-circulating the storage tray extracted from said certain sorting outlet on a closed-loop path of the tray conveyor, and re-circulating the mailpieces corresponding to said other logical destination on a closed-loop path of the mailpiece conveyor.

4. A method according to claim 1, wherein a first subset of the sorting outlets are associated with a first subset of the N logical destinations, and a second subset of the sorting outlets are associated with a second subset of the N logical destinations, and wherein, if it is detected that a logical destination of the second subset of logical destinations is in an overbooked state, a certain sorting outlet that belongs to the first subset of sorting outlets is dynamically allocated to said overbooked logical destination.

5. A method according to claim 1, wherein said certain sorting outlet is chosen by considering the instantaneous or forecast occupancy of the sorting outlets.

6. A method according to claim 1, for sorting mailpieces of the large-format or flats type, wherein a bin carrousel is used for moving the mailpieces along the sorting outlets.

7. A method according to claim 1, wherein M is less than N and the M sorting outlets are associated with only a subset of the N logical destinations.

* * * * *